US008740627B1

(12) United States Patent
Rosenblum

(10) Patent No.: US 8,740,627 B1
(45) Date of Patent: Jun. 3, 2014

(54) POWER OUTLET EXTENSION SYSTEMS AND METHODS

(71) Applicant: Dean Rosenblum, Mount Kisco, NY (US)

(72) Inventor: Dean Rosenblum, Mount Kisco, NY (US)

( * ) Notice: Subject to any disclaimer, the term of this patent is extended or adjusted under 35 U.S.C. 154(b) by 29 days.

(21) Appl. No.: 13/688,721

(22) Filed: Nov. 29, 2012

(51) Int. Cl.
*H01R 13/72* (2006.01)

(52) U.S. Cl.
USPC ..... 439/32

(58) Field of Classification Search
USPC ..... 439/65, 640, 11, 1, 31, 162, 501, 502, 439/531
See application file for complete search history.

(56) References Cited

U.S. PATENT DOCUMENTS

| | | | | | |
|---|---|---|---|---|---|
| 2,362,481 | A | * | 11/1944 | Hartmann | 439/32 |
| 3,815,078 | A | | 6/1974 | Fedrick | |
| 4,046,448 | A | * | 9/1977 | Miller | 439/640 |
| 4,245,873 | A | * | 1/1981 | Markowitz | 439/32 |
| 5,041,002 | A | | 8/1991 | Byrne | |
| D359,722 | S | | 6/1995 | Owens | |
| 5,562,488 | A | | 10/1996 | Neiser et al. | |
| 5,895,275 | A | | 4/1999 | Harbertson | |
| 6,004,138 | A | * | 12/1999 | Harbertson | 439/32 |
| 6,077,086 | A | | 6/2000 | LaRoche | |
| 6,519,208 | B2 | * | 2/2003 | DeVries | 368/10 |
| D472,520 | S | * | 4/2003 | Genicevitch | D13/137.2 |
| 6,653,562 | B2 | | 11/2003 | Kochanski et al. | |
| 7,080,994 | B1 | * | 7/2006 | Lewis | 439/120 |
| 7,081,006 | B2 | * | 7/2006 | Lichtscheidl et al. | 439/501 |
| 7,220,128 | B1 | | 5/2007 | Hicks | |
| 7,396,234 | B2 | * | 7/2008 | Sun | 439/32 |
| 7,824,185 | B2 | * | 11/2010 | Chien | 439/11 |
| 8,197,260 | B2 | * | 6/2012 | Wadsworth | 439/27 |
| 8,616,912 | B1 | * | 12/2013 | Vendura | 439/368 |
| 2010/0081318 | A1 | * | 4/2010 | Mydlarz | 439/501 |

* cited by examiner

*Primary Examiner* — Neil Abrams
*Assistant Examiner* — Phuongchi T Nguyen
(74) *Attorney, Agent, or Firm* — Buckley, Maschoff & Talwalkar LLC

(57) ABSTRACT

Pursuant to some embodiments, a power outlet extension system comprises a base housing a drive motor, a telescoping extension mounted on the base, the telescoping extension having at least a lower section and an upper section, a power strip mounted on a first end of the upper section, the power strip in electrical communication with a power cable, the power cable extending through the telescoping extension and the base to a power outlet, the power cable further in electrical communication with the drive motor for selectively positioning the power strip by extending and retracting the upper section.

17 Claims, 5 Drawing Sheets

POWER OUTLET EXTENSION SYSTEMS AND METHODS

BACKGROUND

As consumers have become increasingly dependent on electronic gadgets and gear, including mobile phones, laptops, tablets, e-readers, and the like, the need for accessible electrical power outlets has increased. Unfortunately, convenient and accessible power outlets are not always available where the consumer needs them, for example, at one's bedside, or near one's couch or reading chair.

And, while existing extension cords and power strips help address this need, they leave two key problems unsolved: convenience and tidiness. Specifically, plugging into extension cords or power strips often requires crawling on the floor to plug something in; and they also often look unsightly—a messy jumble of tangled wires.

As such, it would be desirable to provide power outlet extension systems and methods that solve these and other problems. Other advantages and features will become apparent upon reading the following disclosure.

DESCRIPTION

Embodiments of the present invention relate to power extension systems which provide convenient and attractive access to power outlets and/or other corded electronic connections. Pursuant to some embodiments, a power outlet extension comprises a base housing a drive motor, a telescoping extension mounted on the base, the telescoping extension having at least a lower section and an upper section, a power strip mounted on a first end of the upper section, the power strip in electrical communication with a power cable, the power cable extending through the telescoping extension and the base to a power outlet, the power cable further in electrical communication with the drive motor for selectively positioning the power strip by extending and retracting the upper section. In some embodiments, the lower section is formed as a part of the base.

Figure 1:
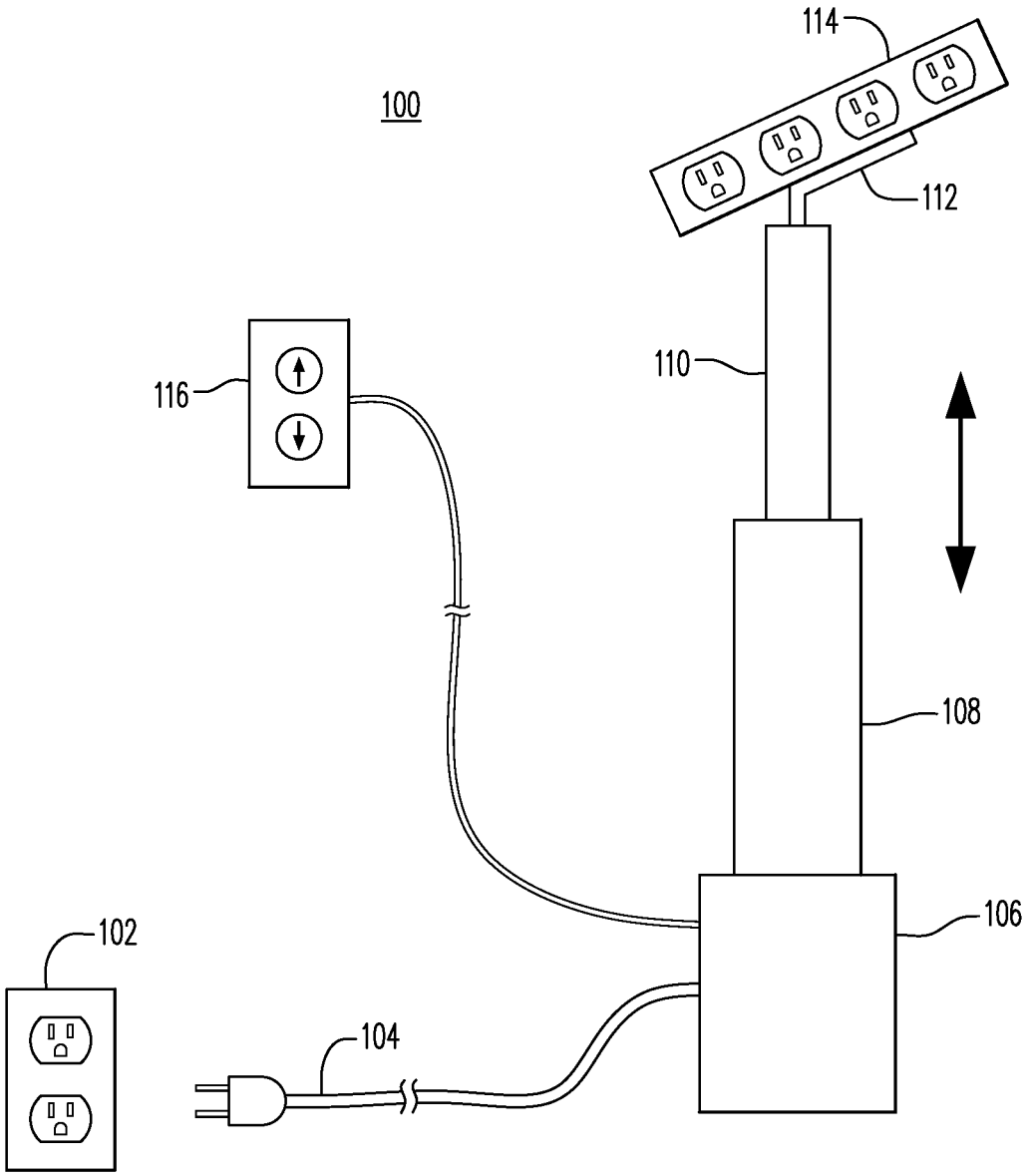
FIG. 1 is a block diagram depicting a system configured pursuant to some embodiments.

Reference is first made to FIG. 1, where a block diagram of a system pursuant to some embodiments is shown. As depicted in FIG. 1, the extension system 100 includes a number of components which together provide a convenient and attractive mechanism for providing power in areas where a wall outlet may be inaccessible or inconvenient. For example, the embodiment depicted in FIG. 1 allows access to a power source such as a wall outlet 102. The system 100 includes a power cord 104 for supplying power from the power source (such as wall outlet 102) to one or more power strip outlets 114 of the system. Pursuant to embodiments of the present invention, the power strip outlets 114 may be extended or moved into a variety of positions as desired by the user.

The plug of the power cord 104 may include a ground fault circuit interruption (GFCI) circuit. As will be appreciated by one skilled in the art, the electronic components of the system 100, including an optional circuit board with surge suppression (not shown), are standard in the industry and therefore will not be discussed herein. The power cord 104 extends from a base 106 and may be retractable into the base 106 or may be a fixed length.

The base 106 supports one or more extension sections which extend and retract to position the height of the power strip 114 as desired by a user. In the embodiment depicted in FIG. 1, two extension sections are provided—a first, lower section 108, and a second, upper section 110. In the embodiment of FIG. 1, the lower section 108 is fixed or stationary, and does not extend or retract vertically. The lower section 108 is mounted on a top portion of the base 106 and is formed to receive the upper section 110 when the upper section 110 is retracted or lowered. In some embodiments, the lower extension section 108 is part of, and integral to the base 106. In some embodiments, the base 106 is formed to provide one or more electrical outlets (not shown) which are in addition to those included in the power strip 114. As will be discussed further herein, the upper section 110 may be movable under control of a gear or drive system, which may be disposed within the lower section 108 or within the base 106. The upper section 110 may be extended or retracted to position the power strip 114 at various heights, allowing the power strip 114 to be conveniently placed for ready access by a user. For example, the system 100 may be positioned behind a piece of furniture, such as a night stand, a desk, a chair, a sofa, or the like, and extended to a position allowing ready access to the power strip 114.

The power strip 114 may be movably mounted on a top portion of the upper section 110 via a mounting hinge 112. Mounting hinge 112 may be an L-shaped hinge that allows the power strip 114 to be positioned at different angles, allowing improved access to the receptacles thereon. Further, the position of the power strip 114 may be rotatable around the center axis of the upper section 110, allowing further adjustment and access to the receptacles of the power strip 114. A power cord (not shown in FIG. 1) may extend through a center of the upper section 110, the lower section 108 and the base 106 providing an electrical connection between the power strip 114 and the power supply 102.

Pursuant to some embodiments, the extension or retraction of the upper section 110 may be controlled by an activation switch 116 which controls a motor or drive system (not shown in FIG. 1). The activation switch 116 may be in communication with the motor or drive system via a wired or wireless connection. The result is an improved power outlet system that allows power outlets to be positioned in a convenient and attractive fashion in a wide variety of positions and locations, and conveniently stored out of site when not in use, all at a user's discretion and control.

Figure 2:
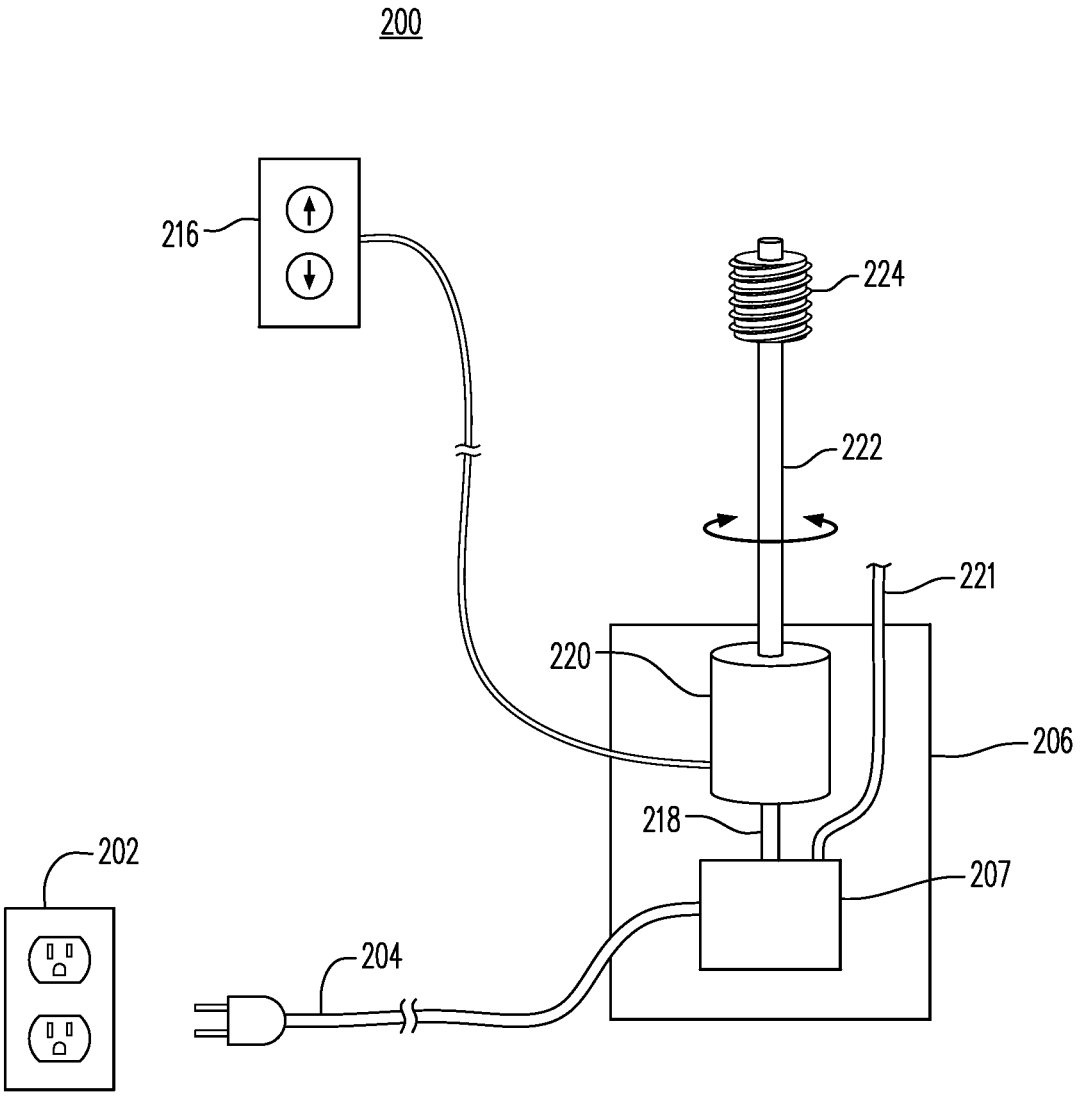
FIG. 2 is a further block diagram of a system configured pursuant to some embodiments.

Reference is now made to FIG. 2 where a cross-sectional view of an embodiment of a system pursuant to some embodiments is shown. In particular, FIG. 2 depicts a portion of a system 200, including a cross-sectional view of components disposed within a base 206 of a system 200 (the exterior of which may appear as that shown in FIG. 1). Similar to the view shown in FIG. 1, the system of FIG. 2 obtains power from a power supply or outlet 202 via a power cord 204. The power cord 204 is shown as extending into the base 206 (e.g., via an aperture, not shown). The power cord 204 is coupled to a divider or step down amplifier 207 which allows power to be provided to a reversible electric motor 220 (via a connector 218). The divider 207 also passes power via 221 to the power strip (not shown in FIG. 2).

The reversible electric motor 220 provides rotational drive to a gear shaft 222 that extends upwardly from the base 206 to a worm gear 224. The worm gear 224 has a number of threads that mate with corresponding slots—effectively a rack gear—disposed within an inner surface of the upper section, (not shown in FIG. 2, shown as item 110 in FIG. 1). As the electric motor 220 turns the gear shaft 222, the worm gear 224 drives the upper section 110 along an axis of the gear shaft 222. Rotation of the upper section 110 may be prevented through use of a track provided on an inner surface of the lower section 108 (not shown). Operation of the reversible electric motor 220 may be controlled by an activation switch 216 in communication with the reversible electric motor 220 via a wireless or wired connection. Those skilled in the art, upon reading this disclosure, will appreciate that a number of different extension mechanisms, including drives and/or motors, may be utilized to provide the longitudinal drive of the upper section 110.

Figure 3:
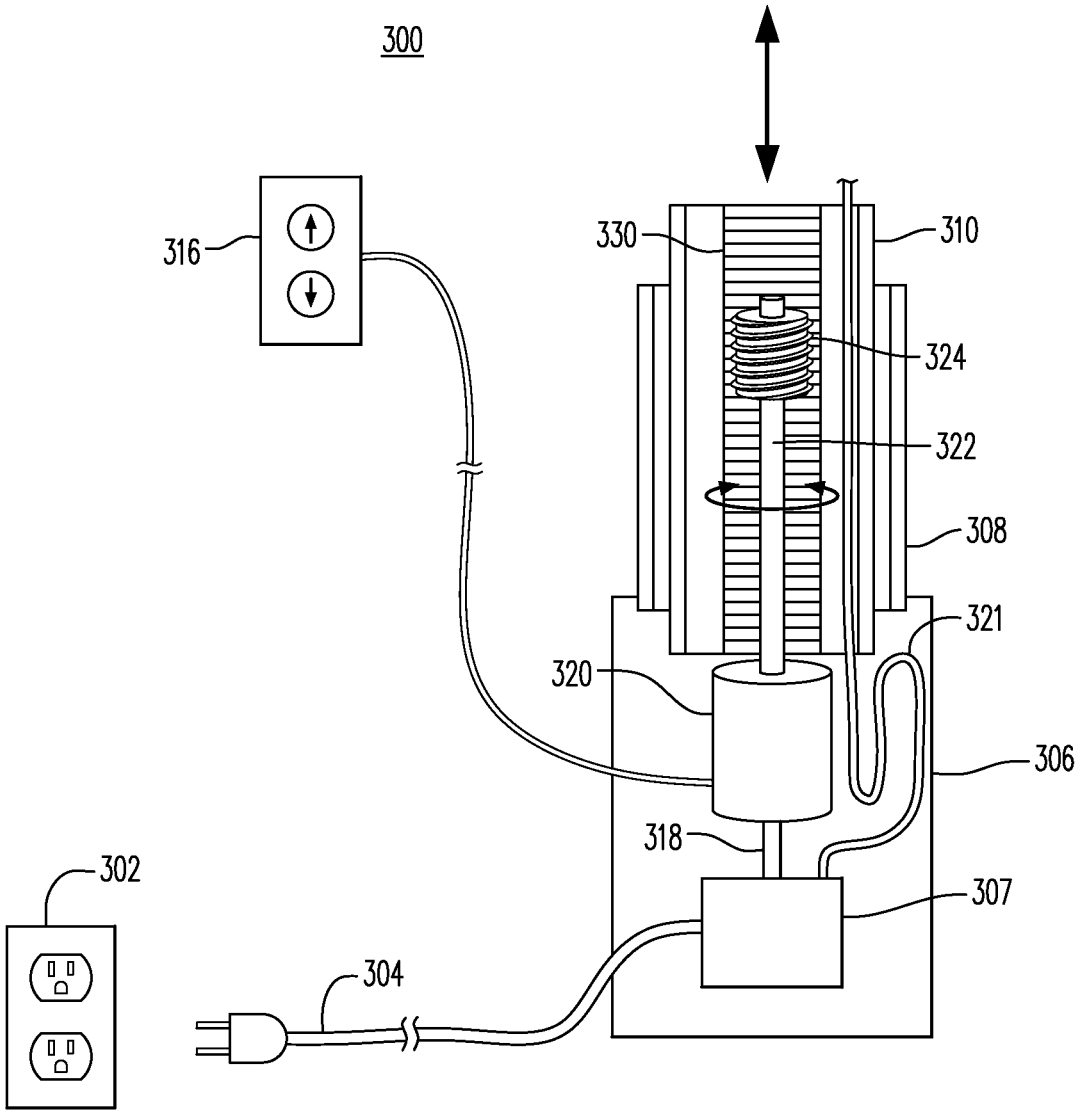
FIG. 3 is a block diagram depicting a portion of a system of FIG. 1 pursuant to some embodiments.

Further details of some embodiments will now be described by reference to FIG. 3, which is a partial side view of the system of FIG. 1. More particularly, the system 300 of FIG. 3 shows a cross sectional view of certain components of the system of FIG. 1 including the base 306, the lower section 308 and the upper section 310. As shown, the base 306 houses components including a divider 307 and a reversible electric motor 320 which drives a rotating gear shaft 322. The shaft 322 has a worm gear 324 positioned to mate with a rack gear 330 mounted on (or formed in) an inner surface of the upper section 310. The worm gear 324 and rack gear 330 mate such that when the worm gear 324 rotates, the rack gear 330 moves longitudinally along the axis of the gear shaft 322 thereby causing the upper section to extend or retract.

The use of a worm gear as shown in FIG. 3 is one example of a drive mechanism that may be used in conjunction with embodiments of the present invention. Such a gear provides a number of benefits, including the ability to deploy a drive mechanism in a narrow cross-sectional profile, allowing the use of a relatively slim upper section 310 and lower section 308. Further, such a drive mechanism provides favorable gearing leverage, where the effort distance of the worm gear 324 (as compared to the resistance distance of the rack gear 330) provides a significant mechanical advantage. By using such a drive mechanism, a smaller, less powerful extension motor 320 may be used, and which can be selected to provide a longer life and lower maintenance.

Referring still to FIG. 3, a brief overview of the operation of the system will now be provided. Once power is supplied to the system (e.g., via power source 302) and the system is positioned in a desired location (e.g., behind a piece of furniture or the like), a user interacts with switch 316. The switch 316 may have directional controls, such as a first button or switch to cause extension of the system, and a second button or switch to cause the system to retract. By interacting with the switch 316, the motor 320 is activated (in a direction corresponding to the directional control) and causes shaft 322 to rotate. Rotation of the shaft 322 causes the worm gear 324 to rotate. Rotation of the worm gear 324 causes the rack gear 330 to extend or retract longitudinally based on the direction of rotation. The upper section 310 extends (or retracts) longitudinally along with the rack gear 330. The lower section 308 remains fixed and does not rotate. When the switch 316 is released, the motor 320 stops, which stops rotation of the shaft 322 as well as the worm gear 324. The upper section 310 locks into position, allowing ready access to the power strip (not shown in FIG. 3, shown as item 114 of FIG. 1) at the extended position desired by the user. The user may then adjust the orientation of the power strip 114 as desired.

While the system has been described as being a separate unit, positionable behind or proximate to a piece of furniture or in other positions as desired, in some embodiments, the system may be built into furniture or other items. For example, referring now to FIG. 4, a built in embodiment of the present invention is shown. For illustrative purposes, the system is shown as built in to a desk, however, those skilled in the art, upon reading this disclosure, will appreciate that embodiments may be installed in or used in conjunction with other items. For example, embodiments may be installed in dressers, night stands, desks, tables, entertainment units, or the like.

Figure 4A:
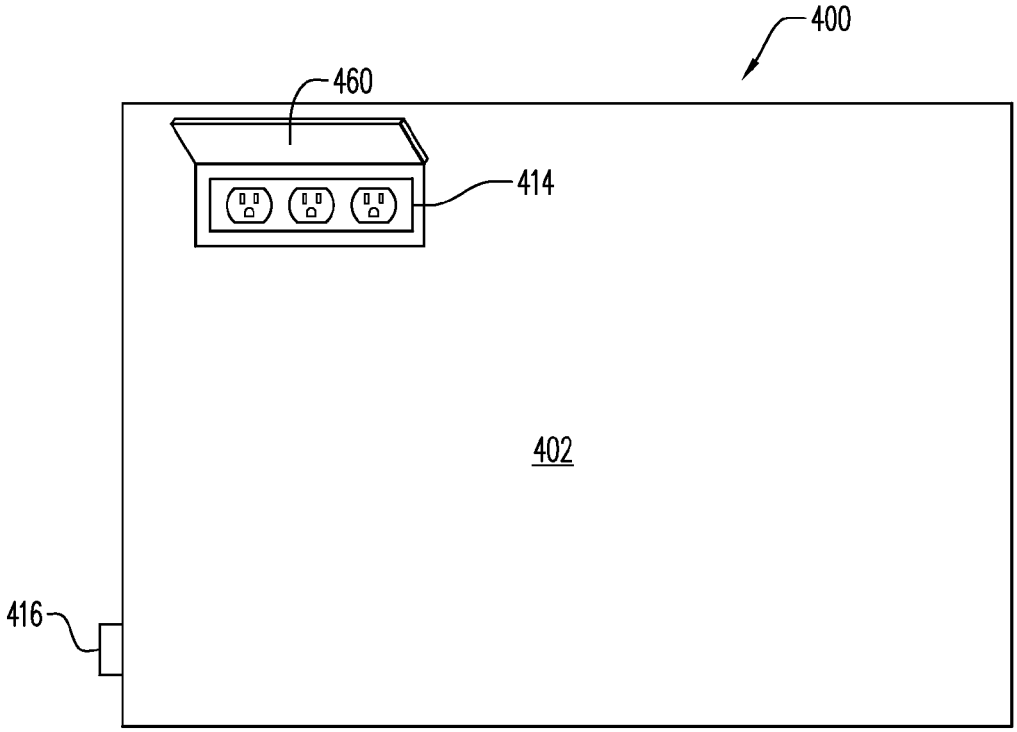
FIGS. 4A-4B are views of a further embodiment of a system pursuant to some embodiments.

Referring first to FIG. 4A, a top view of a desk or a table 400 in which a power supply system pursuant to the present invention has been installed. The desk 400 has a top 402 through which an aperture has been formed to allow access to a power strip 414 positioned atop an upper section (not shown in FIG. 4A) of a power system of the present invention. The power strip 414 may be slightly recessed within the aperture so that a cover 460 may lie flush with the desk top 402. The cover 460 may be a hinged cover, a retractable cover, or the like allowing ready access to the power strip 114 as needed.

Figure 4B:
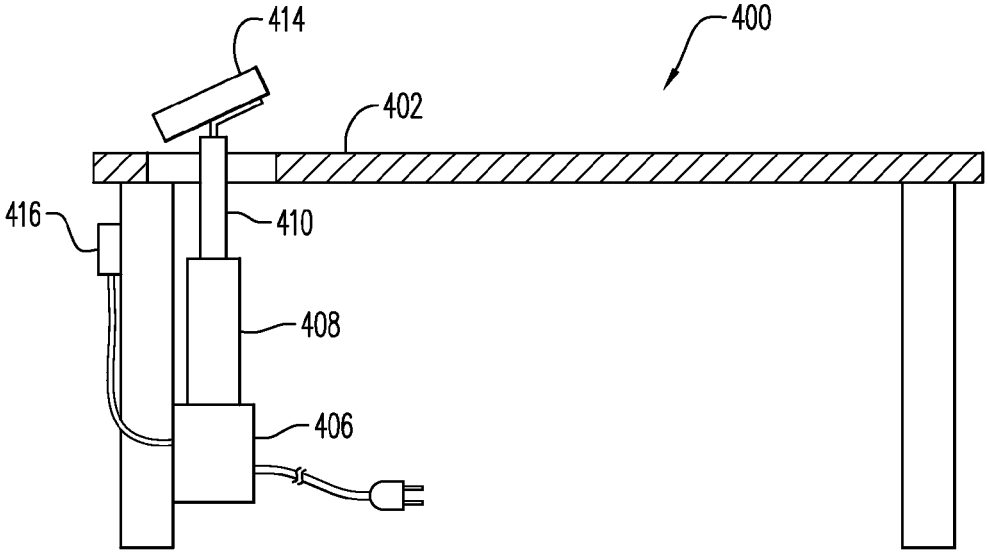

Referring now to FIG. 4B, a side view of a desk or table 400 is shown. As depicted, a power supply system pursuant to the present invention is mounted inside the desk or table 400 such that the components are out of the way, while still providing ready access to the power strip as well as the activation switch 416. The components may be mounted on an inner wall or leg of the desk or table 400 or may be configured to stand on a base of the system (e.g., as shown in FIG. 1). The components may be positioned beneath an aperture in the top 402 of the desk 400 such that when the upper section 410 is extended, it extends the power strip 414 through the aperture for ready access by a user. When the upper section 410 is retracted, it may retract through the aperture so that a cover 460 may be closed over the aperture. The activation switch 416 may be positioned on an outer wall of a side of the desk 400 or in another convenient location. The result is a power supply system that is easily positionable allowing convenient and ready access to a power strip.

Figure 5A:
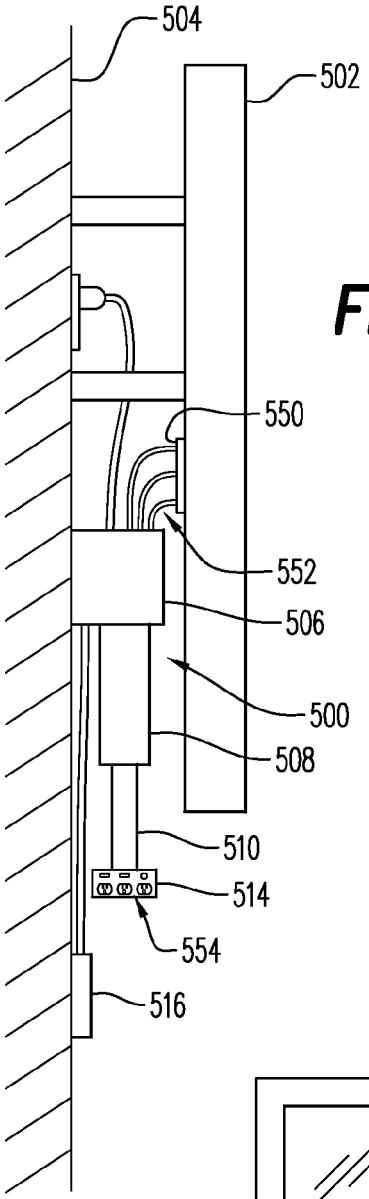
FIGS. 5A-5B are views of a further embodiment of a system pursuant to some embodiments.

Referring now to FIG. 5, a further embodiment of the present invention is shown for use in providing access to device input/output ports for devices such as televisions, stereos, computers or the like, where such ports are inconveniently located on said device. FIG. 5A is a side view of a system 500 for providing access to a television's input/output ports 502 when said TV is installed on a surface 504 such as a wall. It is common to mount devices, such as flat panel televisions, on surfaces for improved viewing. Unfortunately, while such positioning allows improved viewing and aesthetics, it often results in difficult access to power and data or input ports to the television. For example, many televisions currently have a plurality of device input ports 550 located on a back side of the television. If the television is to be connected to other devices (such as video recorders, cable sources, gaming systems, electronic tablets, or the like), it can be difficult to access the device input ports 550 after the television has been mounted on the wall. Embodiments provide an improved system for access to the device input ports 550 as well as for providing access to power for use with other devices.

Figure 5B:
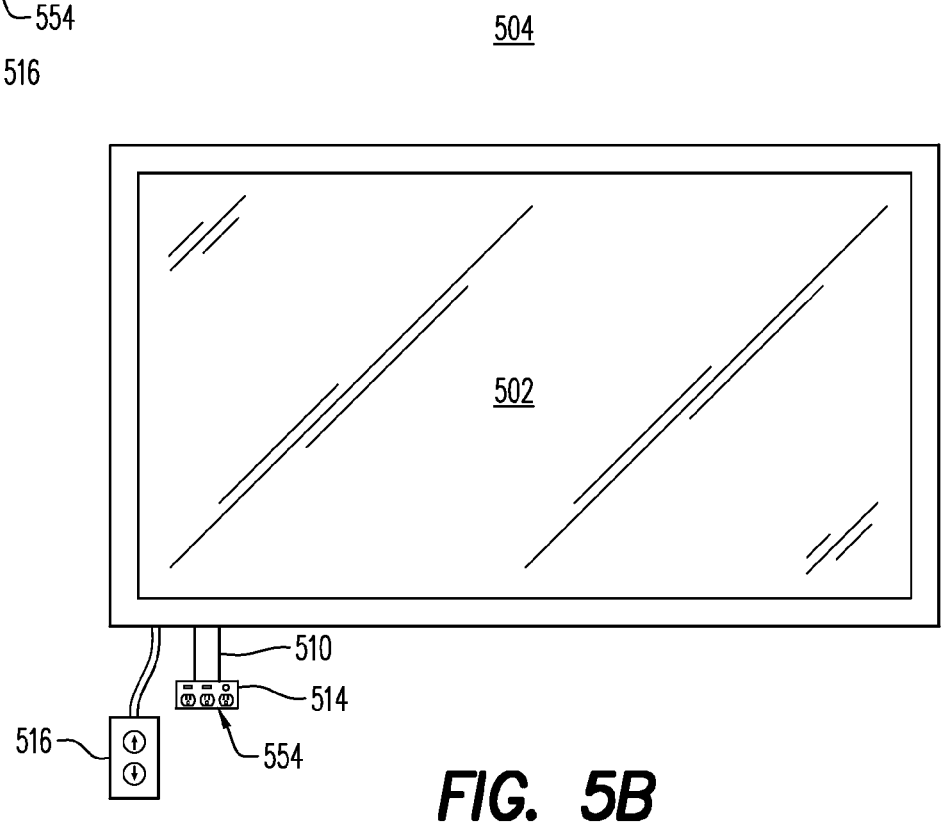

As shown in system 500, an extendable strip 514 is provided which is mounted on a device similar to that shown in FIG. 1 (where a base 506 is mounted on the wall 504). System 500 further includes a lower section 508 and an upper section 510. The extendable strip 514 includes a number of ports 554 corresponding to device input ports 550 commonly found on a television or other electronic unit. For example, the extendable strip 514 may include normal power outlets (for use in providing power to one or more electronic items) as well as ports for video, audio, data, or the like. Ports 554 are connected to device input ports 550 via a plurality of bridge wires 552 which extend to a base 506 and through a body to the extendable strip 514. As shown, the position of the extendable strip 514 may be controlled using an activation switch 516. In this manner, the extendable strip 514 may be extended from behind the television for access to the device input ports on the strip 514, and then retracted after use. A front view of such an embodiment is shown in FIG. 5B, where the television 502 is shown with the extendable strip 514 extended from behind the television 502 for access.

It will be understood that the foregoing description is of exemplary embodiments of the present invention and that the invention is not limited to the specific forms shown or described. For example, while the embodiment depicted in FIG. 1 includes a power strip with six outlets or receptacles; the strip may include more or fewer receptacles. Further, while the receptacles are shown in a single row, multiple rows may be provided. In the embodiment depicted in FIG. 1, two sections are described (one fixed, and one movable). In some embodiments, a different number of sections may be provided (for example, two or more upper movable sections may be provided which telescope to extend the power strip). In some embodiments, one or more power adapters may be built in or attached to the power strip. For example, a power adapter and cord for an Apple iPhone® or other portable device may be formed or provided as a part of the power strip.

Further, although the strip is shown as being substantially rectangular in shape, the strip may be formed in other shapes (such as a pentagonal, hexagonal, square, or other shape). The base, and other sections, may be formed in other shapes as well. For example, the base or other sections may be cylindrical, rectangular, or the like. Further, while a corded electric motor is described herein, a battery powered motor may also be used with desirable results. Further still, while a worm and rack gear combination is described, those skilled in the art will appreciate that other drive mechanisms may also be used. Other embodiments of the strip may include USB-format charging ports, or even retractable charging cables for common devices, such as iPads/iPhones, Blackberries and the like. Further, this present invention may be included as part of, or may itself include a battery back-up system, to provide continuity of power supply to connected devices in the event of an electrical power outage.

In some embodiments, a system herein may connect to, interface with, or integrate with an electrical (i.e., power and/or other signals) system of a vehicle. The vehicle may be a car, a boat, an airplane, a train, a personal transport device, and any other transportation devices or systems. The system may connect to or be integrated into an interior or an exterior of the vehicle. In some regards, the system may provide electrical power for one or more specific voltage(s) and current(s) generated by, for example, the vehicle's on-board electrical systems (e.g., 110 v, 12 v, 5 v, alternating current (AC), direct current (DC), and combinations thereof). In some aspects, the system may include an electrical receptacle to receive one or more specific configurations of electrical plugs and attachments, including but not limited to a 110 v plug, whether grounded or not; a car accessory plug; USB (universal serial bus) plug; etc. In some regards, the system may provide an extension of electrical signals for one or more specific communication signal(s) generated or transmitted by the vehicle, or transmitted to the vehicle's on-board components or systems from an attached external device, including, for example, audio, video, communication (e.g., mobile telephony), data, internet, messaging, and other signals.

In addition to the exemplary embodiments described hereinabove, some embodiments of the present disclosure may include an electrical extension system. While the embodiment depicted in FIG. 1 includes a power strip with a plurality of power outlets or receptacles that are in electrical communication with a power cable, the strip of an electrical extension system herein may include one or more electrical outlets or receptacles which are in electrical communication with an electrical cable, where the electrical outlets may interface or connect to any type of electrical signal and the electrical cable is suitable for carrying the electrical signal. In some aspects, the electrical signal can include one or more specific signal(s) including, for example, audio, video, communication (e.g., telephony), data, internet, messaging, and other signals. In some embodiments the electrical extension system herein may include, alone or in combination, for example, a power cable, power outlet(s), and a drive motor for extending and extracting a telescoping extension, and other aspects, in accordance with some aspects of the present disclosure.

These and other modifications may be made in the design and arrangement of other elements without departing from the scope of the invention as expressed in the appended claims.

Although the present invention has been described in connection with specific exemplary embodiments, it should be understood that various changes, substitutions, and alterations apparent to those skilled in the art can be made to the disclosed embodiments without departing from the spirit and scope of the invention as set forth in the appended claims.

What is claimed is:

1. A power outlet extension system, comprising:
a base housing an extension mechanism;
a telescoping extension mounted on the base, the telescoping extension having at least a lower section and an upper section;
a power strip mounted on a first end of said upper section, the power strip in electrical communication with a power cable, the power cable extending through the telescoping extension and the base to a power outlet, the power cable further in electrical communication with the extension mechanism for selectively positioning the power strip by extending and retracting the upper section;
an activation switch for selectively positioning the power strip, the activation switch coupled to the extension mechanism with at least one of (i) a wired, and (ii) a wireless connection.

2. The power outlet extension system of claim 1, further comprising: a drive motor coupled to the extension mechanism.

3. The power outlet extension system of claim 1, wherein the base is supported by an item of furniture and the power strip extends through an aperture in the item of furniture.

4. The power outlet extension system of claim 1, wherein the base is mounted on a wall and the power strip extends from an item mounted on the wall.

5. The power outlet extension system of claim 1, wherein the lower section of the telescoping extension is formed as part of the base.

6. The power outlet extension system of claim 1, further comprising at least one power outlet on the base.

7. The power extension system of claim 1, wherein the power cable electrically interfaces with an electrical system of a vehicle and is in electrical communication with the power strip.

8. The power outlet extension system of claim 1, wherein the extension mechanism is coupled to a drive shaft that extends through a center of the telescoping extension.

9. The power outlet extension system of claim 8, wherein a worm gear is positioned on an end of the drive shaft opposite the extension mechanism, the worm gear having a plurality of threads mating with corresponding a corresponding interface disposed within an inner surface of the upper section, wherein rotation of the gear shaft causes the upper section to extend and retract from the lower section.

10. The power outlet extension system of claim 1, wherein the base includes at least a first device input port, the device input port in electrical communication with a corresponding device input port on the power strip.

11. The power outlet extension system of claim 10, wherein the at least first device input port is one of a video, audio, data, and an electrical signal port.

12. The power outlet extension system of claim 1, wherein the power strip is mounted on the first end of the upper section with a mounting mechanism allowing the power strip to be positioned at different angles to a center axis of the upper section.

13. The power outlet extension system of claim 12, wherein the mounting mechanism is an L-shaped hinge.

14. The power outlet extension system of claim 12, wherein the mounting mechanism is rotatable.

15. An electrical extension system, comprising:

a base;

a signal cable extending through the base to a signal outlet;

at least one device input port, the at least one device input port being in electrical communication with the signal cable; and an electrical strip, the electrical strip supporting the at least one device input port;

a telescoping extension mounted on the base, the telescoping extension having at least a lower section and an upper section, wherein the electrical strip is mounted on a first end of the upper section, and the signal cable extends through the telescoping extension and the base to the signal outlet;

an extension mechanism housed in the base; and a power cable, the power cable being in electrical communication with the extension mechanism for selectively positioning the electrical strip by extending and retracting the upper section.

16. The electrical extension system of claim 15, further comprising:

a power receptacle mounted on the electrical strip; and a power cable to connect to the power receptacle, the power cable being in electrical communication with a power outlet supported by the base.

17. The electrical extension system of claim 15, further comprising: a power outlet mounted on the electrical strip, the power cable being in electrical communication with the power outlet.

* * * * *